US005738488A

United States Patent [19]

Gazzillo et al.

[11] Patent Number: 5,738,488

[45] Date of Patent: Apr. 14, 1998

[54] GLAND FOR TRANSFERRING COOLING MEDIUM TO THE ROTOR OF A GAS TURBINE

[75] Inventors: Clement Gazzillo, Schenectady; Steven John Croft, Ballston Spa; San-Dar Gau, Schenectady; Denise Marie Parent, Clifton Park, all of N.Y.

[73] Assignee: General Electric Co., Schenectady, N.Y.

[21] Appl. No.: 745,542

[22] Filed: Nov. 12, 1996

[51] Int. Cl.[6] ..... F01D 11/02; F01D 11/04

[52] U.S. Cl. ..... 415/112; 415/111; 415/113; 415/115; 415/168.2; 415/168.4; 415/180; 415/231

[58] Field of Search ..... 415/115, 116, 415/168.2, 168.4, 174.2, 174.5, 176, 180, 230, 231, 111, 112, 113; 416/95, 96 R, 96 A, 97 R

[56] References Cited

U.S. PATENT DOCUMENTS

| | | | |
|---|---|---|---|
| 2,778,601 | 1/1957 | Eckert | 416/96 R |
| 2,788,951 | 4/1957 | Flint | 415/112 |
| 5,120,192 | 6/1992 | Ohtomo et al. | 415/115 |
| 5,575,617 | 11/1996 | Marmilic et al. | 415/176 |
| 5,599,026 | 2/1997 | Sanders et al. | 415/174.5 |

FOREIGN PATENT DOCUMENTS

| | | | |
|---|---|---|---|
| 1194663 | 6/1970 | United Kingdom | 416/95 |

*Primary Examiner*—Christopher Verdier
*Attorney, Agent, or Firm*—Nixon & Vanderhye

[57] ABSTRACT

A gas turbine rotor steam gland includes a steam inlet supply scroll for supplying steam through radial slots to an axially extending passage in the rotor for steam cooling of hot gas path component parts. The scroll decreases in diameter in the circumferential direction of cooling medium flow to match its velocity with the surface speed of the rotor. An aft labyrinth seal is provided about the rotor. Forwardly of the scroll, a plurality of labyrinth-type seals are interspersed with extraction ports. The extraction ports, except for the final forwardmost extraction port, are maintained at a pressure below the pressure of the inlet supply steam whereby steam leakage past the seals flows into the extraction ports for removal. The final forward extraction port is maintained at sub-ambient pressure such that final steam leakage past the forward seals and ambient air leakage past the forwardmost seal combine and are extracted from the steam gland.

12 Claims, 6 Drawing Sheets

GLAND FOR TRANSFERRING COOLING MEDIUM TO THE ROTOR OF A GAS TURBINE

TECHNICAL FIELD

The present invention relates generally to land-based gas turbines employing a cooling medium for cooling hot gas path components and more particularly to a steam gland for transferring cooling steam from a stationary supply pipe to the rotating rotor of the gas turbine.

BACKGROUND

Steam cooling of hot gas path components of a gas turbine has been proposed utilizing available steam from, for example, the heat recovery steam generator and/or steam turbine components of a combined cycle power plant. Steam cooling is advantageous when the steam coolant is provided in a closed circuit whereby the heat energy imparted to the steam as it cools the gas turbine components is recovered as useful work in driving a steam turbine. Steam cooling of hot gas path components of a rotary turbine, however, requires the transfer of the cooling steam from a fixed or stationary supply plenum to a rotating rotor for subsequent distribution to the hot gas path components of the rotor. The transfer must be effective to minimize pressure losses of the cooling steam and to prevent steam leakage into the gas turbine.

DISCLOSURE OF THE INVENTION

In accordance with the present invention, there is provided a cooling medium gland for transferring cooling medium, such as steam, from a stationary supply pipe or plenum to a rotating shaft or rotor in a manner which minimizes or precludes both pressure losses and steam leakage into the exhaust frame inner barrel cavity. To accomplish the foregoing, the steam gland includes an axial inlet for receiving steam from a suitable source and supplying the steam to a circumferential scroll about the rotor. Steam cooling entry slots are provided at circumferentially spaced locations about the rotor in a common plane in registry and communication with the scroll. Consequently, steam is supplied to the scroll and passes through the steam entry slots into a generally axially extending passage in the rotor for subsequent distribution to the rotating components of the rotor requiring cooling.

Particularly, the steam inlet scroll is varied in cross-section in a circumferential direction to produce a steam velocity that matches the rotor tangential velocity, thus minimizing pressure losses. Accordingly, the scroll cross-sectional area thus decreases in a circumferential direction to ensure the matching of the velocity of the steam in the scroll to the rotor surface tangential velocity thereby maintaining a generally constant pressure steam input about the circumference of the rotor. After the steam has passed into the rotor passage and cooled the hot gas path components, the spent steam returns through a central passageway along the rotor centerline for exit through an outlet steam pipe attached to the aft end of the steam gland and aligned with the rotor shaft axis.

On the aft side of the steam supply inlet scroll, there is provided a labyrinth-type seal. Inlet steam escaping past this aft seal axially outwardly in an aft direction combines with the spent return cooling steam in the outlet steam pipe for subsequent use, e.g., in a steam turbine. Forwardly of the inlet scroll, there is provided one or more labyrinth-type seals spaced axially one from the other with extraction ports spaced between them for extracting steam leaking past the labyrinth seals. For example, a pair of labyrinth-type seals are provided forwardly of the inlet scroll and an extraction port is provided between the pair of seals. The extraction port is maintained at a pressure lower than the steam inlet supply pressure so that leakage past the first seal of the pair of seals flows into this first extraction port. Additional seals may be provided forwardly of the pair of seals with an extraction port between axially adjacent seals maintained at a lower pressure for similarly extracting leakage steam past each seal. A final labyrinth-type seal is also provided having an extraction port between it and all other seals forwardly of the inlet scroll. The final extraction port is maintained at a sub-ambient pressure to draw both ambient air across the final seal and any leakage steam past the labyrinth seals into the final extraction port. This provides a final seal for any incidental steam leakage across the seals and precludes leakage of steam into the inner barrel cavity. Thus, steam is prevented from deleteriously affecting the instrumentation in the inner barrel cavity and also the rotor bearing.

Each seal includes a plurality of generally circumferentially extending segments, each of which has a plurality of axially spaced teeth projecting radially inwardly from the seal toward the rotor. Thus, the seal segments combine to provide a 360° sealing ring about the rotor. The tips of the teeth are spaced radially outwardly of the rotor. The seal segments are biased by springs between the segments and the stationary housing to provide a radial inward load and enables radial outward movement of the segments as necessary. Preferably, the steam gland is formed of a nickel-based alloy to prevent corrosion under operating steam conditions.

In a preferred embodiment according to the present invention, there is provided a turbine, comprising a rotor carrying hot gas path components for rotation about a rotor axis, the rotor having a passage for supplying a cooling medium to the components and a plurality of cooling medium entry slots opening radially about the rotor in communication with the rotor passage, a cooling medium gland for transferring cooling medium from a fixed supply to the passage of the rotating rotor, the gland including a fixed cooling medium inlet supply scroll about the rotor for supplying cooling medium to the slots at a predetermined pressure and having an inlet for receiving cooling medium for flow in one circumferential direction about the scroll, the scroll having a decreasing cross-sectional area in the one circumferential direction of cooling medium flow about the scroll to substantially match the circumferential velocity of the cooling medium flow about the scroll to the tangential velocity of the rotor.

In a further preferred embodiment according to the present invention, there is provided in a turbine having a rotor carrying hot gas path components for rotation about a rotor axis, a passage through the rotor for supplying a cooling medium to the components, and a plurality of cooling medium entry slots opening radially about the rotor in communication with the rotor passage, a cooling medium gland for transferring cooling medium from a fixed supply to the passage of the rotating rotor, comprising a fixed cooling medium inlet supply scroll about the rotor for supplying cooling medium to the slots at a predetermined pressure, a pair of seals axially spaced from the scroll and about the rotor and at least one cooling medium extraction port between the seals of the pair thereof maintained at a pressure lower than the predetermined pressure to extract cooling medium leakage past a seal of the pair of seals located axially between the cooling medium inlet supply scroll and the extraction port.

Accordingly, it is a primary object of the present invention to provide a novel and improved apparatus for transferring a cooling medium, such as steam, for the hot gas path components of a gas turbine from a stationary supply plenum to a rotating rotor while minimizing pressure losses and preventing steam leakage into the exhaust frame of the inner barrel cavity of the gas turbine.

BEST MODE FOR CARRYING OUT THE INVENTION

Figure 1:
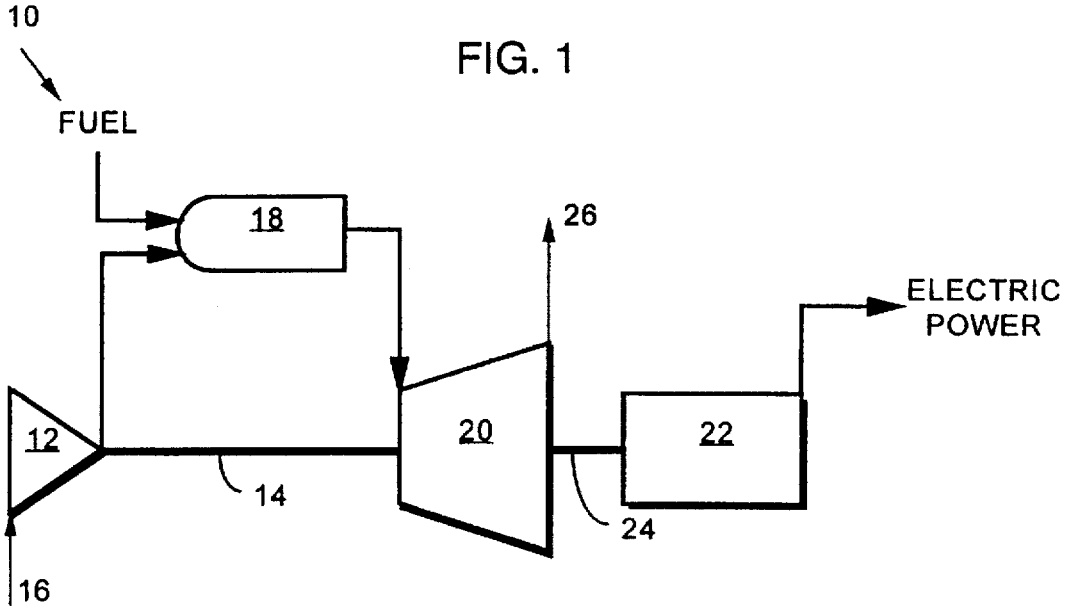
FIG. 1 is a schematic illustration of a gas turbine incorporating the present invention.

FIG. 1 is a schematic diagram for a simple cycle, single-shaft heavy-duty gas turbine 10 incorporating the present invention. The gas turbine may be considered as comprising a multi-stage axial flow compressor 12 having a rotor shaft 14. Air enters the inlet of the compressor at 16, is compressed by the axial flow compressor 12 and is then discharged to a combustor 18 where fuel such as natural gas is burned to provide high-energy combustion gases which drive the turbine 20. In the turbine 20, the energy of the hot gases is converted into work, some of which is used to drive the compressor 12 through shaft 14, with the remainder being available for useful work to drive a load such as a generator 22 by means of rotor shaft 24 for producing electricity. A typical simple cycle gas turbine will convert 30 to 35% of the fuel input into shaft output. All but 1 to 2% of the remainder is in the form of exhaust heat which exits turbine 20 at 26. Higher efficiencies can be obtained by utilizing the gas turbine 10 in a combined cycle configuration in which the energy in the turbine exhaust stream is converted into additional useful work.

Figure 2:
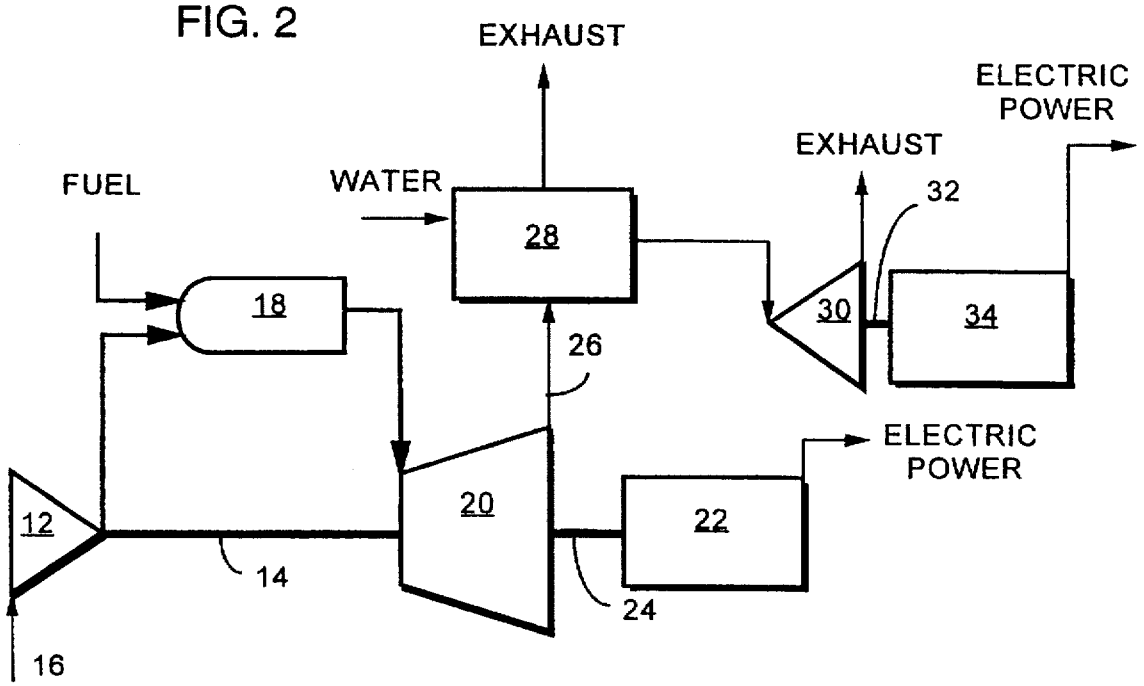
FIG. 2 is a schematic diagram of a combined cycle system incorporated in the present invention and employing a gas turbine and heat recovery steam generator for greater efficiency.

FIG. 2 represents a combined cycle in its simplest form, in which the exhaust gases exiting turbine 20 at 26 enter a heat recovery steam generator 28 where water is converted to steam in the manner of a boiler. Steam thus produced drives a steam turbine 30 in which additional work is extracted to drive through shaft 32 an additional load such as a second generator 34 which, in turn, produces additional electric power. In some configurations, turbines 20 and 30 drive a common generator. Combined cycles producing only electrical power are in the 50 to 60% thermal efficiency range using the more advanced gas turbines.

Figure 3:
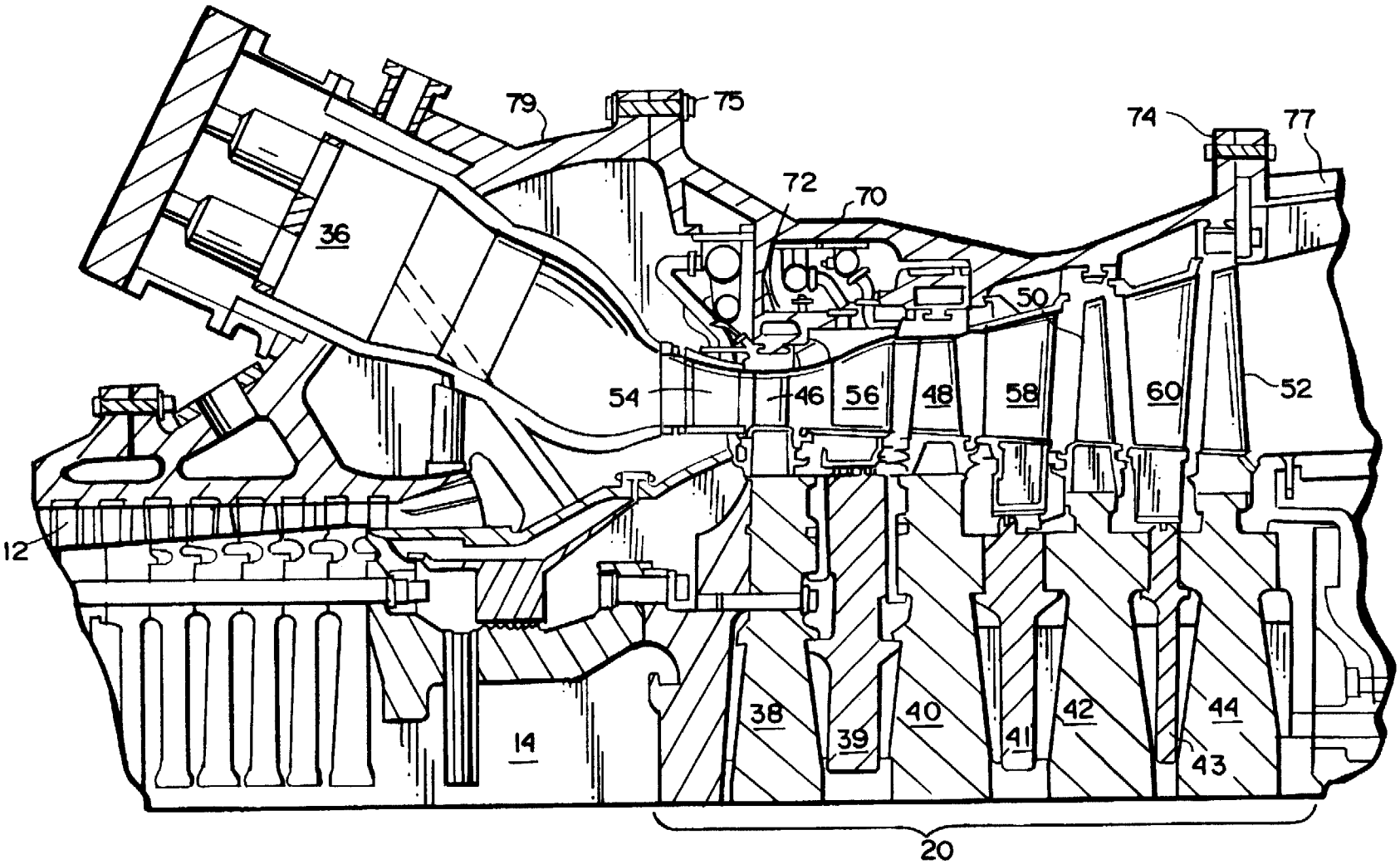
FIG. 3 is a cross-sectional view of a portion of a gas turbine illustrating its combustion, compressor and turbine rotor sections.

FIG. 3 illustrates in greater detail a gas turbine which may be used in the combined cycle configuration of FIG. 2. Air from the compressor 12 is discharged to the combustion cans comprising combustor 18, the combustion cans being located circumferentially about the rotor shaft 14 in the usual fashion, one such "can" being shown at 36. Following combustion, the resultant combustion gases are used to drive the turbine section 20, which includes in the instant example four successive stages represented by four wheels 38, 40, 42 and 44 comprising the turbine rotor and mounted to the rotor shaft 14 for rotation therewith, and each carrying a row of buckets represented, respectively, by blades 46, 48, 50 and 52, which are arranged alternately between fixed nozzles represented by vanes 54, 56, 58 and 60, respectively. The rotor also includes spacer discs 39, 41 and 43 alternately arranged between the bucket wheels. Thus, it will be appreciated that a four-stage turbine is illustrated wherein the first stage comprises nozzles 54 and buckets 46; the second stage, nozzles 56 and buckets 48; the third stage, nozzles 58 and buckets 50; and the fourth stage, nozzles 60 and buckets 52. As in the below-identified patent applications, the first and second stage nozzles 54 and 56 are mounted on an inner shell 72 pinned to an outer shell 70 mounting the third and fourth stage nozzles. The outer shell 70 is removable at the bolt flanges 74 and 75 bolting the outer shell to the turbine housing sections 77 and 79, respectively, whereby the upper outer shell and inner shells 72 are removable from the turbine for access to the hot gas path components.

For a generalized description of the state of the development of the turbine just described, reference is made to the following co-pending patent applications: Ser. No. 08/414,698, entitled "Removable Inner Turbine Shell with Bucket Tip Clearance Control", Ser. No. 08/414,700, now U.S. Pat. No. 5,536,143, entitled "Closed Circuit Steam Cooled Bucket"; and Ser. No. 08/414,697, now U.S. Pat. No. 5,634,766, entitled "Turbine Stator Vane Segments having Combined Air and Steam Cooling Circuits", the disclosures of which are incorporated herein by reference.

Figure 4:
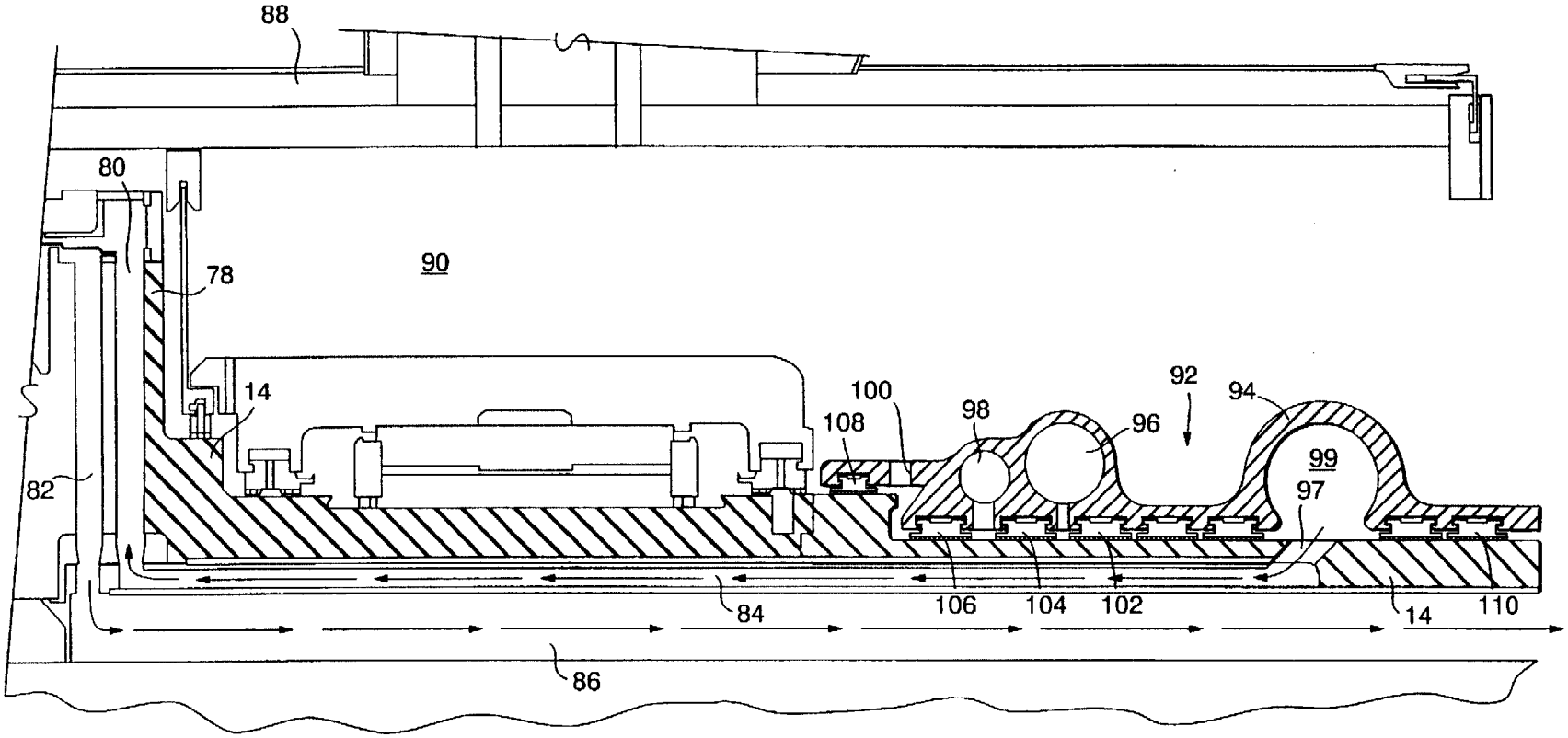
FIG. 4 is a schematic illustration of an aft portion of the rotor section of the gas turbine illustrating the cooling inlet and outlet for the cooling medium for the rotor and hot gas path components.

Referring now to FIG. 4, there is provided an end disk 78 which includes cooling supply and return passages 80 and 82 in communication with the axial supply and return passages 84 and 86, respectively, through rotor 14. An exhaust frame inner housing barrel 88 forms a stationary part of the turbine surrounding a cavity 90 containing various instrumentation as well as the rotor bearing housing and in which cavity 90 is mounted a cooling medium transfer gland, generally indicated 92, according to the present invention. The fixed cooling medium gland 92 includes a cooling medium supply inlet scroll 94 and a plurality of extraction ports 96, 98 and 100 located forwardly along the gland 92 from the inlet scroll 94. First, second, third and fourth seals 102, 104, 106 and 108, respectively, are spaced axially along the gland 92 forwardly of the inlet scroll 94. A fifth seal 110 is disposed about the aft side of the gland 92 aft of the inlet scroll 94. The extraction ports 96, 98 and 100 are located between the seals 102, 104; 104, 106; and 106, 108, respectively.

Figure 5:
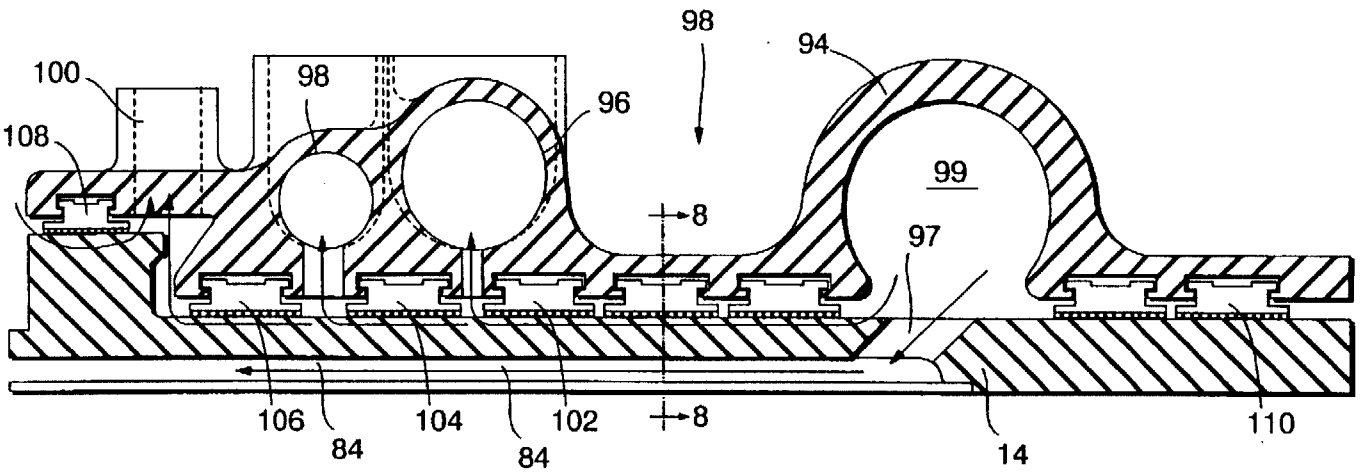
FIG. 5 is an enlarged cross-sectional view of a cooling medium gland according to the present invention.
Figure 6A:
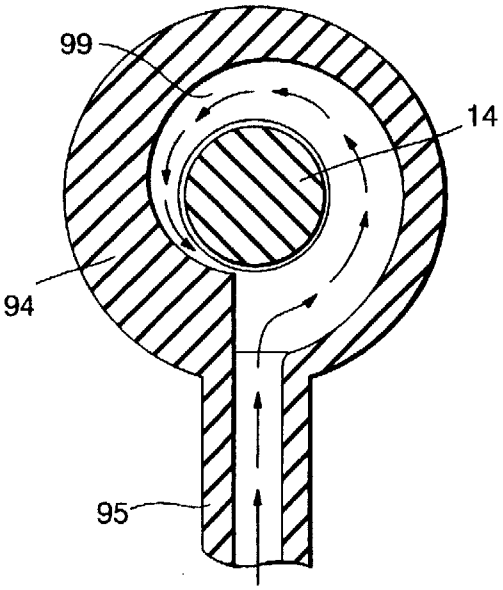
FIG. 6A is a schematic cross-sectional view of the scroll illustrating its decrease in cross-sectional area in the circumferential direction of steam flow.
Figure 6:
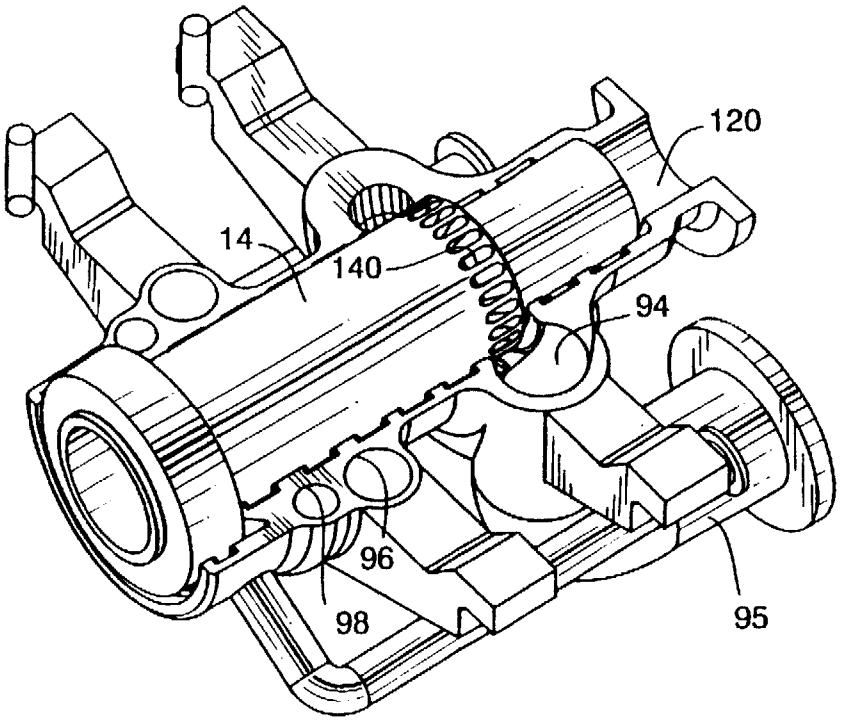
FIG. 6 is a perspective view with parts broken away for ease of illustration of the cooling gland for transferring cooling medium from the inlet scroll into the rotor.

Scroll 94 has an axial inlet 95 (see FIGS. 6 and 7) which turns radially to supply the cooling medium, e.g., steam, to the scroll for flow in one circumferential direction about the scroll. The rotor has a plurality of circumferentially spaced, radially extending slots 97 (FIG. 5) for receiving steam from scroll 94 and transferring the steam into the axial supply passage 84, the scroll having an exit slot extending a full 360° about the scroll in registration with the rotor and communication with slots 97. The scroll has an internal cross-section defining the circumferentially extending passage 99 which decreases in the direction of flow of the steam about the scroll to substantially preclude pressure losses as the steam enters the radial entry slots 97 of the rotor. The cross-sectional area of the scroll at each circumferential location can be determined from the desired mass flow of steam, its temperature and pressure, and the speed of the rotor, all known factors. Thus, the scroll decreases in cross-sectional area to maintain the velocity of the steam substantially matched to the surface speed of the rotor and hence minimizing or eliminating pressure losses in transferring steam from the fixed scroll to the rotor.

Figure 8:
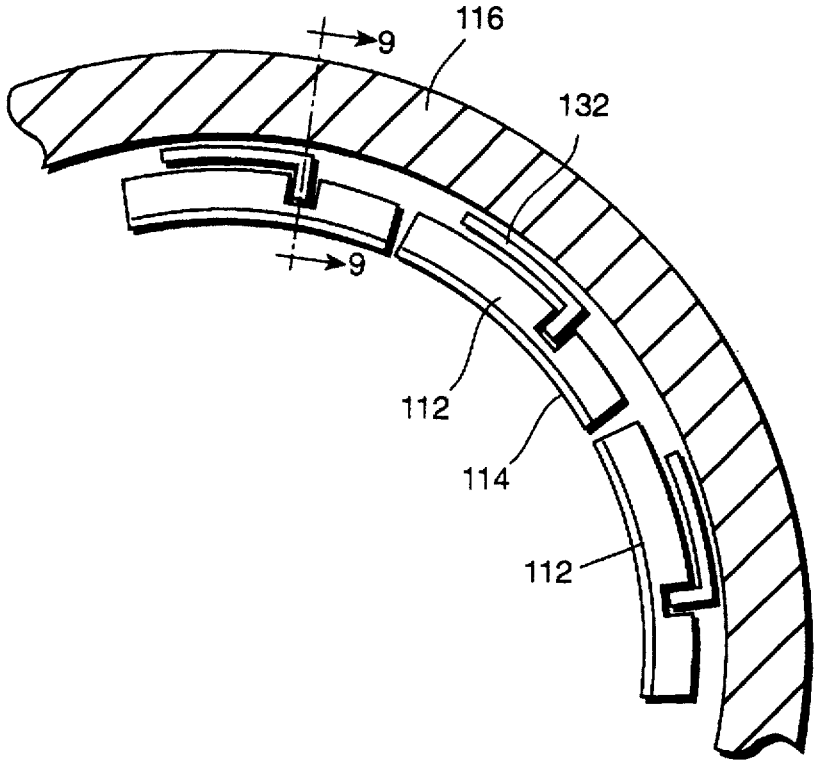
FIG. 8 is an enlarged fragmentary cross-sectional view of a portion of the gland illustrating the sealing segments and taken generally about on lines 8—8 in FIG. 5.
Figure 9:
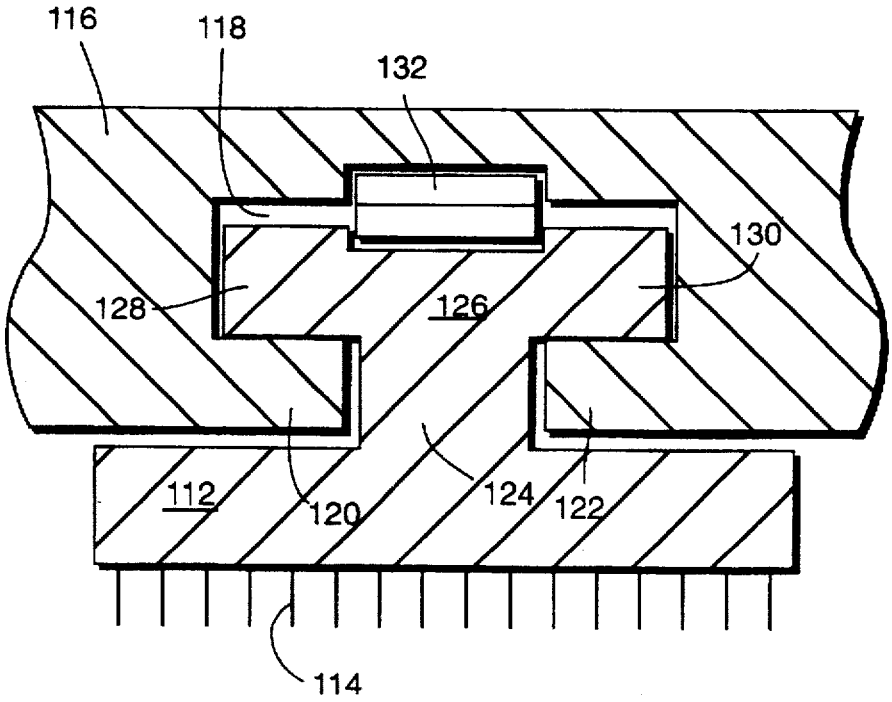
FIG. 9 is a cross-sectional view thereof taken generally about on line 9—9 of FIG. 8.

As best illustrated in FIGS. 8 and 9, each of the seals 102, 104, 106, 108 and 110 comprises a plurality of individual seal segments 112 disposed about the rotor 14 in circumferentially spaced relation one to the other. Each segment 112 includes a plurality of axially spaced, arcuately projecting labyrinth teeth 114 projecting radially inwardly from the arcuate segment 112 toward, but spaced from, the rotor 14 forming a labyrinth seal with the rotor 14. The seal housings 116 within gland 92 are provided with arcuate, generally T-shaped slots 118 and flanges 120 and 122 projecting axially toward one another. Each seal segment 112 includes a radially outwardly projecting neck portion 124 terminating in an enlarged head 126 having axially extending flanges 128 and 130 disposed in the T-shaped housing 116. Radial clearances are provided between the housing 116 and the flanges of the segments whereby the segments 112 can be displaced in the housing 116 in a generally radial direction. A spring 132 is provided between the housing and the radially outermost portion of the segments to bias the segments in a radially inward direction. Radially outward movements of the segments are therefore accommodated when necessary.

It will be appreciated that a cooling medium, preferably steam, is supplied the inlet scroll 94 from a suitable source at a predetermined pressure and passes into the plurality of circumferentially spaced, radially extending slots 97 for transfer into the axial supply passage 84. It will also be appreciated, particularly with the use of labyrinth-type seals, that there is leakage of the cooling medium, e.g., steam, past the seals 102, 104 and 106 and that such leakage steam must be prevented from entry into the exhaust frame inner barrel cavity 90. To preclude leakage into cavity 90, the one or more extraction ports forwardly of the inlet scroll 94 are maintained at a pressure lower than the predetermined pressure of the cooling medium supplied to the scroll 94. For example, extraction port 96, in the form of a scroll between seals 102 and 104, is coupled to a low-pressure steam turbine and is maintained at a pressure lower than the cooling medium supply pressure in inlet scroll 94 whereby leakage past the seal 102 will flow into the lower pressure scroll of extraction port 96. The extraction port 98 located between seals 104 and 106 is coupled, for example, to a steam seal regulator and is maintained at a pressure lower than the predetermined pressure of the steam supplied to scroll 94. Similarly, steam leakage past seals 102 and 104 flows into the extraction port 98 for removal. The extraction port 100 is coupled to a condensor and is maintained at or below ambient pressure. Thus, steam leakage past seals 102, 104 and 106 in a forward axial direction, combines with ambient air leakage past seal 108 in an aft axial direction for flow into and removal by the extraction port 100. Thus, final seal 108 removes any incidental or residual steam leakage across the seals 102, 104 and 106, consequently preventing steam leakage into the inner barrel cavity. It will be appreciated that the second extraction port 98 can be omitted, leaving only the first extraction port 96 maintained at a lower pressure than the inlet cooling medium supply pressure, followed by the extraction port 100, maintained at sub-ambient pressure. It will also be appreciated that extraction ports and labyrinth-type seals in addition to those illustrated can be provided between the inlet scroll and the final extraction port 100 as necessary.

Figure 7:
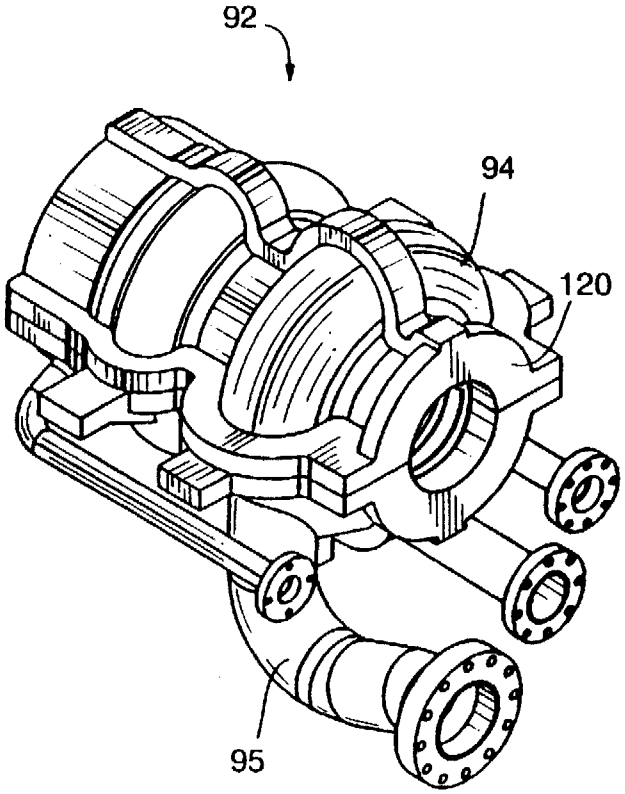
FIG. 7 is a perspective view of the cooling medium gland illustrating an axial inlet and outlet for the cooling medium.

It will be appreciated from a review of the drawing figures that the steam return 86 axially through the rotor passes through the end of the rotor (FIG. 7). In FIG. 7, the opening 120 at the aft end of the steam gland serves to carry the return steam to a steam return pipe (not shown). Leakage past the aft seal in the aft direction is combined with the spent cooling steam for flow to other parts of the system.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine, comprising:

a rotor carrying hot gas path components for rotation about a rotor axis, said rotor having a passage for supplying a cooling medium to said components and a plurality of cooling medium entry slots opening generally radially about said rotor in communication with said rotor passage;

a cooling medium gland for transferring cooling medium from a fixed supply to the passage of the rotating rotor;

said gland including a cooling medium inlet supply scroll about said rotor for supplying cooling medium to said slots and having an inlet for receiving cooling medium for flow in a generally circumferential direction within said scroll;

said scroll having a decreasing cross-sectional area in the direction of cooling medium flow within said scroll to substantially match the circumferential velocity of the cooling medium flow within the scroll to the tangential velocity of said rotor.

2. A turbine according to claim 1 wherein said cooling medium entry slots lie in a plane normal to the axis of rotation of said rotor, said scroll lying substantially in said plane.

3. A turbine according to claim 1 including a pair of seals spaced axially forwardly of said scroll and about said rotor; and at least one cooling medium extraction port between the seals of said pair thereof maintained at a pressure sufficient to extract cooling medium leakage past a seal of said pair of seals.

4. A turbine according to claim 3 wherein said scroll is disposed about the rotor such that the cooling medium is supplied to the cooling medium entry slots in a substantially tangential direction relative to said rotor.

5. A turbine according to claim 3 wherein each of said pair of seals includes a plurality of seal segments disposed in a circumferential array about said rotor, each said segment including a plurality of radially inwardly extending teeth.

6. A turbine according to claim 5 including a spring for each segment for biasing each segment radially inwardly.

7. A gas turbine comprising:

a rotor carrying hot gas path components for rotation about a rotor axis, a passage through said rotor for supplying a cooling medium to said components, and a plurality of cooling medium entry slots opening generally radially about said rotor in communication with said rotor passage;

a cooling medium gland for transferring cooling medium from a fixed supply to the passage of the rotating rotor;

a fixed cooling medium inlet supply scroll defining a passage about said rotor for supplying cooling medium to said slots, said passage having a decreasing cross-sectional area in a direction of rotation of said rotor;

a pair of seals axially spaced from said scroll and about said rotor; and at least one cooling medium extraction port between the seals of said pair thereof maintained at a pressure lower than a predetermined pressure of the cooling medium supplied said passage sufficient to extract cooling medium leakage past a seal of said pair of seals.

8. A gas turbine according to claim 7 wherein each of said pair of seals includes a plurality of seal segments disposed in a circumferential array about said rotor, each said segment including a plurality of radially inwardly extending teeth.

9. A gas turbine according to claim 8 including a spring in each segment for biasing each segment radially inwardly.

10. A gas turbine according to claim 7 wherein the cooling medium is steam.

11. A gas turbine comprising:

a rotor carrying hot gas path components for rotation about a rotor axis, a passage through said rotor for supplying a cooling medium to said components, and a plurality of cooling medium entry slots opening generally radially about said rotor in communication with said rotor passage;

a cooling medium gland for transferring cooling medium from a fixed supply to the passage of the rotating rotor;

a fixed cooling medium inlet supply scroll about said rotor for supplying cooling medium to said slots;

a pair of seals axially spaced from said scroll and about said rotor; and at least one cooling medium extraction port between the seals of said pair thereof maintained at a pressure sufficient to extract cooling medium leakage past a seal of said pair of seals;

said scroll being disposed about the rotor such that the cooling medium is supplied to the cooling medium entry slots in a substantially tangential direction relative to said rotor, the cross-sectional area of the scroll being sized to provide a cooling medium flow velocity which substantially matches the rotor tangential velocity.

12. A gas turbine comprising:

a rotor carrying hot gas path components for rotation about a rotor axis, a passage through said rotor for supplying a cooling medium to said components, and a plurality of cooling medium entry slots opening generally radially about said rotor in communication with said rotor passage;

a cooling medium gland for transferring cooling medium from a fixed supply to the passage of the rotating rotor;

a fixed cooling medium inlet supply scroll about said rotor for supplying cooling medium to said slots;

a pair of seals axially spaced from said scroll and about said rotor; and at least one cooling medium extraction port between the seals of said pair thereof maintained at a pressure sufficient to extract cooling medium leakage past a seal of said pair of seals;

said scroll having an inlet for the cooling medium and the cross-sectional area of the scroll decreases from said inlet in the direction of the cooling medium flow about said scroll.

* * * * *